US008991946B1

(12) United States Patent
Braggs

(10) Patent No.: US 8,991,946 B1
(45) Date of Patent: Mar. 31, 2015

(54) HAIR STYLING ACCESSORY ORGANIZER

(76) Inventor: Carolyn Braggs, Monroe, LA (US)

( * ) Notice: Subject to any disclaimer, the term of this patent is extended or adjusted under 35 U.S.C. 154(b) by 0 days.

(21) Appl. No.: 13/553,506

(22) Filed: Jul. 19, 2012

(51) Int. Cl.
*A47F 3/10* (2006.01)

(52) U.S. Cl.
USPC ..... 312/125; 312/305

(58) Field of Classification Search
USPC ..... 312/249.1, 249.2, 249.4, 283, 285, 290, 312/305, 294, 125, 135; 206/581
See application file for complete search history.

(56) References Cited

U.S. PATENT DOCUMENTS

| | | | | | |
|---|---|---|---|---|---|
| 542,189 | A | * | 7/1895 | Fraizer | 312/234.2 |
| 1,416,566 | A | * | 5/1922 | McCleary | 312/125 |
| 2,626,062 | A | * | 1/1953 | Manzella | 211/59.1 |
| 3,876,065 | A | | 4/1975 | Phelps | |
| 4,487,316 | A | * | 12/1984 | Calhoun et al. | 206/443 |
| 4,533,328 | A | * | 8/1985 | McDaniel | 434/94 |
| 4,850,658 | A | | 7/1989 | Sandor | |
| 5,168,985 | A | | 12/1992 | Shih | |
| 5,211,284 | A | | 5/1993 | Parks | |
| 5,303,855 | A | * | 4/1994 | Veale | 223/85 |
| 5,370,453 | A | | 12/1994 | Wolff | |
| 5,400,810 | A | * | 3/1995 | Taylor | 132/232 |
| 5,678,908 | A | * | 10/1997 | Wang | 312/264 |
| D387,497 | S | * | 12/1997 | Guiliano | D28/73 |
| 5,762,184 | A | * | 6/1998 | Greiner | 206/6.1 |
| 5,833,052 | A | | 11/1998 | Diamond | |
| 5,875,794 | A | | 3/1999 | Ekman | |
| D437,711 | S | * | 2/2001 | Berg | D6/436 |
| 6,241,105 | B1 | | 6/2001 | Pomper | |
| 6,425,647 | B1 | | 7/2002 | Pothin | |
| 6,601,714 | B2 | * | 8/2003 | Bladek | 211/85.2 |
| 6,820,755 | B1 | | 11/2004 | Ranjit | |
| D544,151 | S | * | 6/2007 | Kieren | D28/73 |
| D564,762 | S | * | 3/2008 | Vecchiola | D4/128 |
| 7,793,793 | B1 | | 9/2010 | Sykes | |
| 7,891,506 | B2 | | 2/2011 | Kornowski | |
| D648,540 | S | * | 11/2011 | Rennette | D4/128 |
| 2002/0112736 | A1 | * | 8/2002 | Dashefsky | 132/286 |
| 2004/0164034 | A1 | * | 8/2004 | Costanza | 211/13.1 |
| 2004/0164037 | A1 | * | 8/2004 | Phillips | 211/85.3 |
| 2004/0188368 | A1 | * | 9/2004 | Hildreth | 211/85.3 |
| 2005/0218090 | A1 | * | 10/2005 | Sepanek | 211/13.1 |
| 2008/0230433 | A1 | * | 9/2008 | Mulaw | 206/534 |
| 2009/0057249 | A1 | * | 3/2009 | Donnellan | 211/77 |
| 2009/0065373 | A1 | * | 3/2009 | Kornowski | 206/6.1 |
| 2010/0005933 | A1 | * | 1/2010 | Cline | 81/124.3 |
| 2013/0221145 | A1 | * | 8/2013 | Reynolds | 242/125.2 |

* cited by examiner

*Primary Examiner* — Darnell Jayne
*Assistant Examiner* — Ryan A Doyle
(74) *Attorney, Agent, or Firm* — R. Keith Harrison

(57) ABSTRACT

A hair styling accessory organizer includes an organizer base; an organizer platform carried by the organizer base; and at least one generally elongated hair head support member upward-standing from the organizer platform, the hair bead support member having a base portion carried by the organizer platform, a tapered portion of varying cross-sectional diameter extending from the base portion and a terminal portion extending from the tapered portion.

15 Claims, 2 Drawing Sheets

HAIR STYLING ACCESSORY ORGANIZER

FIELD

Illustrative embodiments of the disclosure generally relate to devices for storing twin hair beads and other hair styling accessories. More particularly, illustrative embodiments of the disclosure relate to a hair styling accessory organizer for storing twin hair beads and other hair styling accessories in an organized and accessible manner.

BACKGROUND

Common hair styling accessories include such items as twin hair beads, hair brushes, combs, barettes, clips, bows and the like. A typical conventional pair of twin hair heads includes a pair of spherical balls or beads which are connected by an elastic band. After the hair is arranged into a pigtail or ponytail, the hand is wrapped around the hair to secure the pigtail or ponytail. The beads on the elastic band are typically one of various colors to impart a selected appearance to the hair.

In a residential setting, hair styling accessories are commonly stored together in a drawer inside a bathroom. However, this may cause the twin hair beads and other items to inadvertently become clumped together, twisted, tangled and/or misplaced. Therefore, twin hair beads of a desired color become difficult to locate and frequently must be untangled when their use is desired.

Accordingly, a hair styling accessory organizer for storing twin hair beads and other hair styling accessories in an organized and accessible manner may be desirable for some applications.

SUMMARY

The disclosure is generally directed to a hair styling accessory organizer for storing twin hair beads and other hair styling accessories in an organized and accessible manner. An illustrative embodiment of the hair styling accessory organizer includes an organizer base; an organizer platform carried by the organizer base; and at least one generally elongated hair head support member upward-standing from the organizer platform, the hair bead support member having a base portion carried by the organizer platform, a tapered portion of varying cross-sectional diameter extending from the base portion and a terminal portion extending from the tapered portion.

BRIEF DESCRIPTION OF THE DRAWINGS

Illustrative embodiments of the disclosure will now be described, by way of example, with reference to the accompanying drawings, in which.

DETAILED DESCRIPTION

Figure 2:
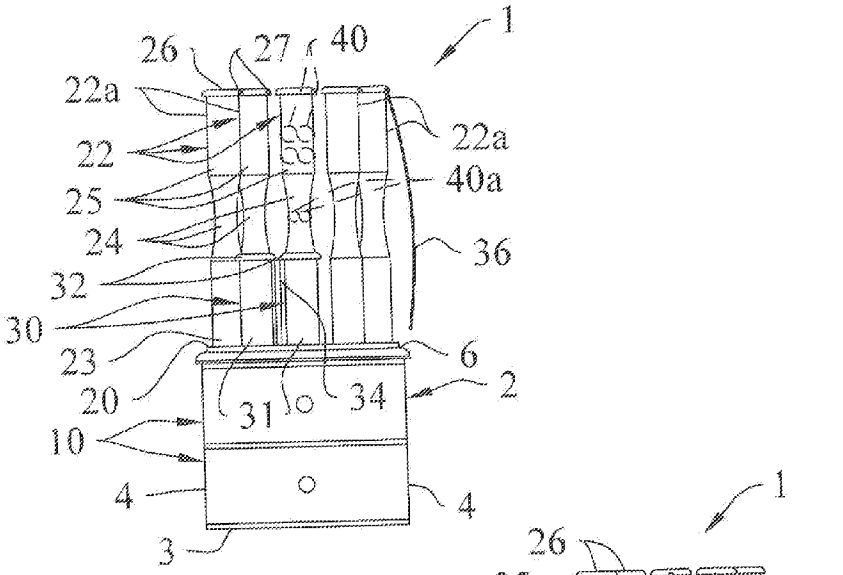
FIG. 2 is a front view of an illustrative embodiment of the hair styling accessory organizer.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is non-limiting, and is not necessarily to be construed as preferred or advantageous over other implementations. All of the implementations described below are exemplary implementations provided to enable persons skilled in the art to practice the disclosure and are not intended to limit the scope of the appended claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. Relative terms such as "front" and "rear" as used herein are intended for descriptive purposes only and are not necessarily intended to be construed in a limiting sense.

Referring to FIGS. 1-5 the drawings, an illustrative embodiment of the hair styling accessory organizer is generally indicated by reference numeral 1. As will be hereinafter further described, the hair styling, accessory organizer 1 is suitable for storing various hair styling accessories such as twin hair heads, hair brushes, combs, barettes, clips, bows and the like in an organized and accessible manner. The various components of the hair styling accessory organizer 1 may be plastic, wood, metal or other material or any combination thereof and may be fabricated using conventional molding, casting, machining and/or other fabrication techniques known by those skilled in the art.

The hair styling accessory organizer 1 includes an organizer base 2. In some embodiments, the organizer base 2 may have a generally rectangular box shape with an organizer base bottom panel 3; a pair of parallel, spaced-apart organizer base side panels 4 upward-standing from opposite side edges of the organizer base bottom panel 3; an organizer base rear panel 5 extending from a rear edge of the organizer base bottom panel 3 between the organizer base side panels 4; and an organizer base top panel 6 supported by the organizer base side panels 4 and the organizer base rear panel 5. In other embodiments, the organizer base 2 may have a circular shape or may be triangular, pentagonal, hexagonal or other polyhedral shape.

Figure 1:
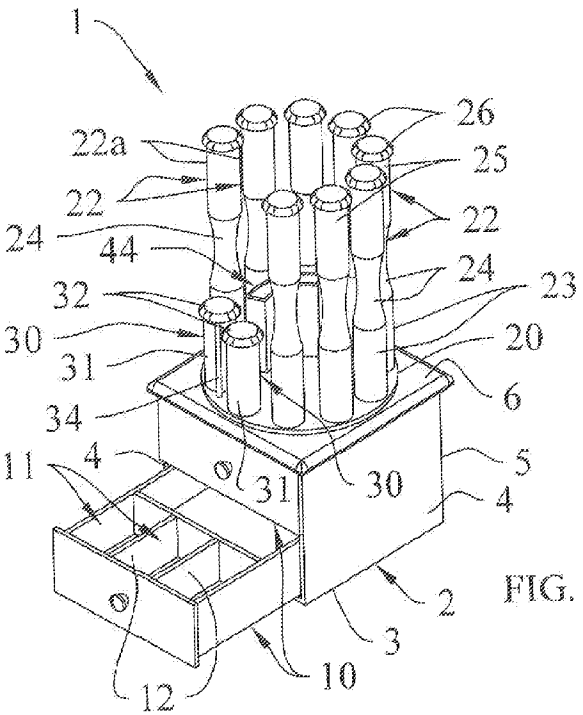
FIG. 1 is a front perspective view of an illustrative embodiment of the hair styling accessory organizer, with a drawer extended from an organizer base of the hair styling accessory organizer.
Figure 5:
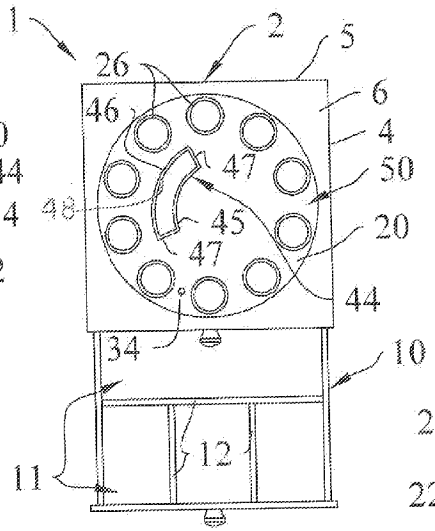
FIG. 5 is a top view of an illustrative embodiment of the hair styling accessory organizer, with the drawer in an open position.

In some embodiments, at least one drawer 10 may be selectively extendable from the organizer base 2. In the illustrative embodiments illustrated in FIGS. 1 and 2, a pair of upper and lower drawers 10 is selectively extendable from the organizer base 2. As illustrated in FIGS. 1 and 5, each drawer 10 may include multiple drawer compartments 11 divided by partitions 12. The drawer compartments 11 may be sized and shaped to contain various hair styling accessories (not illustrated), as will be hereinafter described. Each drawer 10 may have a closure mechanism (not illustrated) such as magnets, for example and without limitation, which secures the drawer 10 in the closed position such as during transport of the hair styling accessory organizer 1.

An organizer platform 20 is provided on the organizer base 2. In some embodiments, the organizer platform 20 may be circular and may be mounted for manual rotation with respect to the organizer base 2 according to techniques which are well-known by those skilled in the art. At least one generally elongated, upward-standing hair head support member 22 is provided on the organizer platform 20. As illustrated in FIG. 2, each hair bead support member 22 is adapted to support one or multiple twin hair beads 40, 40*a* of various sizes in an organized and accessible manner as will be hereinafter further described. In some embodiments, multiple hair bead support members 22 may be provided on the organizer platform 20 in adjacent, spaced-apart relationship to each other around the circumference of the organizer platform 20, as illustrated. While the illustrative embodiment illustrated in FIG. 1 is shown having 8 hair bead support members 22, it will be recognized that in some embodiments a greater or lesser number of the hair bead support members 22 may extend from the organizer platform 20.

Figure 7:
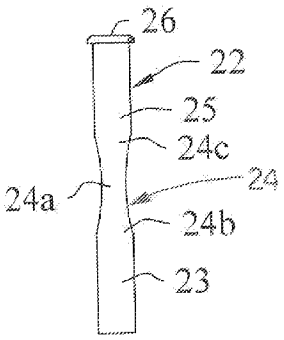
FIG. 7 is a side view of a hair bead support member according to an illustrative embodiment of the hair styling accessory organizer.

As illustrated in FIG. 7, each hair bead support member 22 may be graduated in cross-sectional diameter along its length. Accordingly, each hair bead support member 22 may include a base portion 23 which extends upwardly from the organizer platform 20, a tapered portion 24 which extends upwardly from the base portion 23 and a terminal portion 25 which and extends upwardly from the tapered portion 24. The base portion 23 may be generally elongated and cylindrical and in some embodiments may be fabricated in one piece with the organizer platform 20. Alternatively, the hair bead support members 22 and the organizer platform 20 may be fabricated in separate pieces and the base portion 23 of each hair bead support member 22 attached to the organizer platform 20 via gluing, mechanical fasteners and/or other suitable attachment technique known by those skilled in the art. The terminal portion 25 may be generally elongated and cylindrical and in some embodiments may have a cross-sectional diameter which is substantially the same as the diameter of the base portion 23. The cross-sectional diameters of the base portion 23 and the terminal portion 25 may be substantially constant along the length of each.

Figure 3:
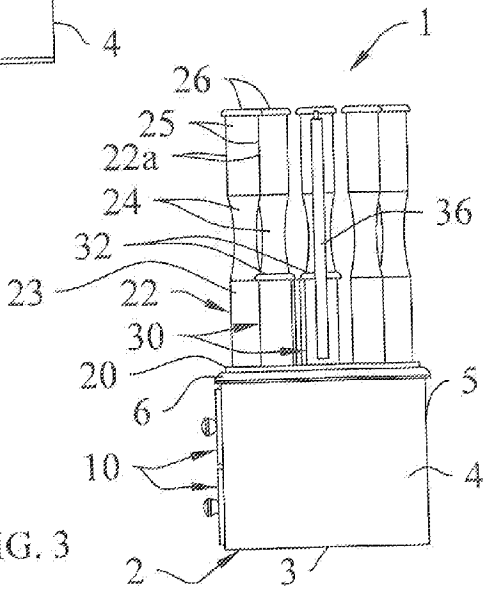
FIG. 3 is a left side view of an illustrative embodiment of the hair styling accessory organizer with the drawer in a closed position.
Figure 6:
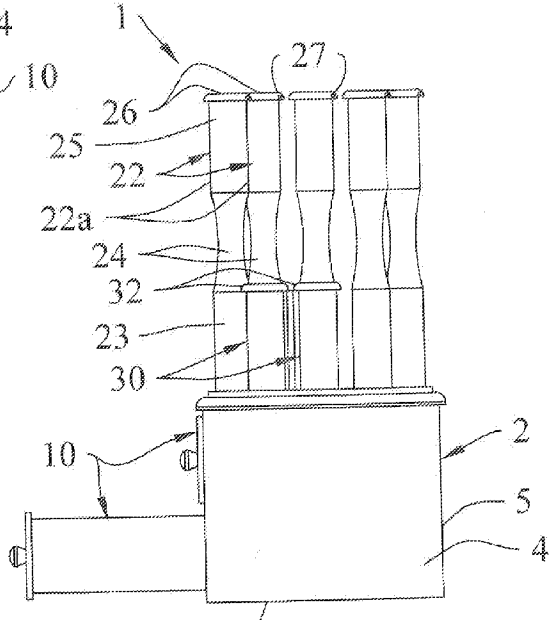
FIG. 6 is a left side view of an illustrative embodiment of the hair styling accessory organizer with the drawer in the open position.

The tapered portion 24 has a reduced cross-sectional diameter relative to the base portion 23 and the terminal portion 25 of each hair bead support member 22. In some embodiments, the tapered portion 24 may have a varying cross-sectional diameter along its length with a generally curved and biconcave shape when viewed from the side, as illustrated in FIGS. 2, 3 and 6. Therefore, the tapered portion 24 may have a middle segment 24*a* and a lower segment 24*b* and an upper segment 24*c* which extend from the middle segment 24*a*. The lower segment 24*b* may gradually increase in cross-sectional diameter from the middle segment 24*a* to the base portion 23. Likewise, the upper segment 24*c* may gradually increase in cross-sectional diameter from the middle segment 24*a* to the terminal portion 25.

The base portion 23, the tapered portion 24 and the terminal portion 25 of each hair bead support member 22 have a support member surface 22*a*. In some embodiments, the support member surface 22*a* may be textured to maintain the hair beads 40, 40*a* (FIG. 2) in place and prevent the hair beads 40, 40*a* from inadvertently shifting or falling on the hair bead support member 22 such as during rotation of the organizer platform 20 on the organizer base 2.

In some embodiments, a cap 26 may be provided on the upper end of at least one of the hair head support members 22. The cap 26 may have a cap opening 27. The cap opening 27 may facilitate attachment of an accessory support ribbon 36 (FIGS. 2 and 3) to the cap 26. Accordingly, in application of the hair styling accessory organizer 1, which will be hereinafter described, barrettes (not illustrated) and/or other hair styling accessories may be attached to the accessory support ribbon 36, which supports the hair styling accessories in an organized and accessible manner.

In some embodiments, at least one upward-standing accessory support member 30 may be provided on the organizer platform 20. The accessory support member 30 may include a shaft portion 31 which may be generally elongated and cylindrical and may have a substantially constant diameter along its length. The shaft portion 31 may be fabricated in one piece with the organizer platform 20, or alternatively, may be fabricated separately and attached to the organizer platform 20 via gluing, mechanical fasteners and/or other suitable attachment technique known by those skilled in the art. The accessory support member 30 may be adapted to support one or multiple scrunches (not illustrated), large rubber bands (not illustrated) or the like. A cap 32 may be provided on the upper end of the shaft portion 31 of the accessory support member 30. The cap 32 may facilitate attachment of an accessory support ribbon 36 to the accessory support member 30, as was heretofore described with respect to FIGS. 2 and 3.

In some embodiments, at least one hair bun spindle 34 may extend upwardly from the organizer platform 20 such as between the accessory support members 30. One or multiple hair bans (not illustrated) may be attached to the hair bun spindle 34 in an organized and accessible manner.

Figure 4:
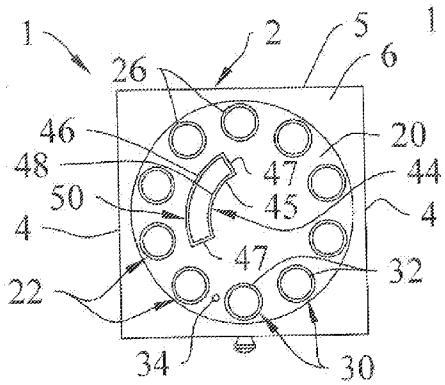
FIG. 4 is a top view of an illustrative embodiment of the hair styling accessory organizer, with the drawer in a closed position.

As illustrated in FIGS. 1, 4 and 5, in some embodiments, at least one hair styling accessory compartment 44 may be provided on the organizer platform 20. The hair styling accessory compartment 44 may be located off center with respect to the geometric center of the organizer platform 20. The hair styling accessory compartment 44 may include a generally curved inner compartment wall 45, a generally curved outer compartment wall 46 which is generally spaced-apart and parallel to the inner compartment wall 45 and a pair of compartment sidewalls 47 which connect the outer compartment wall 46 to the inner compartment wall 45. The inner compartment wall 45, the outer compartment wall 46 and the compartment sidewalls 47 may be fabricated in one piece with the organizer platform 20 or may be fabricated separately and attached to the organizer platform 20 via gluing, mechanical fasteners and/or other suitable attachment technique known by those skilled in the art. The hair styling accessory compartment 44 has a compartment interior 48 which is adapted to contain hair styling accessories (not illustrated) such as combs, brushes, barrettes, ribbons and the like, as will be hereinafter described. As illustrated in FIG. 1, the accessory support members 30 may be shorter in length than the hair bead support members 22 on the organizer platform 20 to facilitate access of a user to the hair styling accessory compartment 44.

As illustrated in FIGS. 4 and 5, a hair styling accessory space 50 may be defined by and between the hair bead support members 22 and the outer compartment wall 46 of the hair styling accessory compartment 44. The hair styling accessory space 50 may be sized and configured to contain hair bands (not illustrated) and/or other hair styling accessories as will be hereinafter described.

In exemplary application, the hair styling accessory organizer 1 is used to store various types of hair styling accessories such as large twin hair beads 40 and/or small twin hair heads 40*a* of one or more different sizes, rubber bands, scrunches, head bands, combs, brushes, barrettes and ribbons, for example and without limitation, in an organized and accessible manner. The large twin hair beads 40 and the small twin hair heads 40*a* may be conventional hair beads in which a pair of colored plastic beads is connected by an elastic band. The large twin hair heads 40 may be fabricated in a larger size than the small twin hair beads 40 or may have initially been small twin hair beads 40*a* which have become stretched through repeated use. As illustrated in FIG. 2, one or more pairs of large twin hair beads 40 can be attached to the terminal portion 25 of one or more of the hair bead support members 22. Each pair of large twin hair beads 40 can be attached to the terminal portion 25 of the hair bead support member 22 by wrapping the elastic band around the terminal portion 25 and inserting one of the beads through the band such that the beads engage each other and retain the large twin hair beads 40 on the terminal portion 25. One or more pairs of small twin hair beads 40*a* can in like manner be attached to the tapered portion 24 of the hair bead support member 22. The diameters of the terminal portion 25 and the tapered portion 24 facilitate secure attachment of the respective large hair bead or beads 40 and small hair bead or beads 40*a* to the hair head support member 22. Moreover, it will be appreciated by those skilled in the art that the varying diameter of the tapered portion 24 in some embodiments facilitates snug attachment of twin hair heads 40*a* having various sizes to the hair head support member 22.

It will be appreciated by those skilled in the art that twin hair heads 40, 40*a* may be organized on different ones of the hair head support members 22 around the circumference of the organizer platform 20 according to the various styles, designs and/or colors of the twin hair beads 40, 40*a*. Accordingly, twin hair beads 40, 40*a* having a particular style, design and/or color can be easily identified and accessed when its use is desired.

When use of a particular hair bead 40, 40*a* is desired, a user (not illustrated) of the hair styling accessory organizer 1 can manually rotate the organizer platform 20 on the organizer base 2 to selectively position the hair bead support member 22 to which the desired hair head 40, 40*a* is attached in order to position the hair bead 40, 40*a* for ease in selection and detachment of the hair bead 40, 40*a* from the hair bead support member 22. In some embodiments, the textured support member surface 22*a* of each hair bead support member 22 prevents the hair beads 40, 40*a* from inadvertently sliding and becoming misplaced on the hair bead support member 22, particularly as the organizer platform 20 is rotated on the organizer base 2.

Various other hair styling accessories can be stored in an organized and accessible manner on the hair styling accessory organizer 1. For example, an accessory support ribbon 36 can be attached to the cap 26 on one or more of the hair bead support members 22. One or more barrettes (not illustrated) can be attached to the accessory support ribbon 36 typically by engagement of the conventional barrette clip (not illustrated) on the barrette with the accessory support ribbon 36. A particular barrette can be selected for use by disengagement of the barrette clip thereof from the accessory support ribbon 36. Multiple accessory support ribbons 36 can be attached to the caps 26 of respective hair bead support members 22. Barrettes can be organized on the different accessory support ribbons 36 according to color, size and/or style for ease of identification, access and retrieval when a barrette having a particular color, size and/or style is to be used. Flair styling accessories (not illustrated) such as scrunches and rubber hands, for example and without limitation, can be wrapped around the accessory support members 30 for storage and organization thereof. Hair styling accessories (not illustrated) such as brushes and combs, for example and without limitation, can be placed in the compartment interior 48 of the hair styling accessory compartment 44 for storage. One or more hair bands (not illustrated) can be stored in the hair styling accessory space 50 (FIGS. 4 and 5) between the hair bead support members 22 and the hair styling accessory compartment 44. Additional hair styling accessories such as rubber bands, bobby pins, clamps, night caps, do rags, scarves and the like can be stored in the drawer compartments 11 (FIG. 5) in one or both of the drawers 10. Items such as oil, gel, mousse, lotions and the like can be stored on the flat center portion of the organizer platform 20 between the hair band support members 22 and the hair styling accessory compartment 44. One or multiple hair buns (not illustrated) may be attached to the hair bun spindle 34 in an organized and accessible manner.

It will be appreciated by those skilled in the art that the hair styling accessory organizer 1 provides a large surface area in a space-efficient configuration for storage of a variety of hair styling accessories in an organized and accessible manner. Because much of the storage space which is provided by the hair styling accessory organizer 1 is vertical, counter space is maximized. The hair styling accessory organizer 1 can be stored on a countertop or vanity without obstructing or encroaching on storage of other household items which are typically stored in a child's bedroom or bathroom. The rotating organizer platform 20 allows the organizer base 2 to remain stationary while the hair styling accessories on the hair head support members 22 and accessory support members 30 are accessible by rotating the organizer platform 20 on the organizer base 22. The hair head support members 22 may be spaced-apart to enable the hands of a user to comfortably extend between the hair head support members 22 in retrieving twin hair beads or other accessories.

While the embodiments of the disclosure have been described above, it will be recognized and understood that various modifications can be made and the appended claims are intended to cover all such modifications which may fall within the spirit and scope of the disclosure.

What is claimed is:

1. A hair styling accessory organizer, comprising:

an organizer base;

an organizer platform carried by the organizer base;

at least one generally elongated hair bead support member upward-standing from the organizer platform, the hair bead support member having a base portion carried by the organizer platform, a tapered portion of varying cross-sectional diameter extending from the base portion and a terminal portion extending from the tapered portion; a cap carried by the at least one hair bead support member; and wherein an accessory support ribbon is carried by the cap.

2. The hair styling accessory organizer of claim 1 wherein the tapered portion is biconcave in longitudinal cross-sectional view.

3. The hair styling accessory organizer of claim 1 wherein the organizer platform is rotatable on the organizer base.

4. The hair styling accessory organizer of claim 1 wherein the at least one hair bead support member comprises a plurality of hair bead support members.

5. The hair styling accessory organizer of claim 4 wherein the organizer platform is circular and the hair bead support members are generally arranged around a circumference of the organizer platform.

6. The hair styling accessory organizer of claim 1 further comprising at least one drawer extendable from the organizer base.

7. A hair styling accessory organizer, comprising:

an organizer base;

a rotatable circular organizer platform carried by the organizer base;

a plurality of generally elongated hair bead support members upward-standing from the organizer platform in adjacent, spaced-apart relationship to each other generally around a circumference of the organizer platform, each hair bead support member having a base portion of substantially constant cross-sectional diameter carried by the organizer platform, a tapered portion of varying cross-sectional diameter extending from the base portion and a terminal portion of substantially constant cross-sectional diameter extending from the tapered portion;

a hair styling accessory compartment carried by the organizer platform;

a cap carried by the at least one of the plurality of hair bead support members and a cap opening in the cap; and an accessory support ribbon carried by the cap opening in the cap.

8. The hair styling accessory organizer of claim 7 wherein the tapered portion is biconcave in longitudinal cross-sectional view.

9. The hair styling accessory organizer of claim 7 wherein the organizer platform is rotatable on the organizer base.

10. The hair styling accessory organizer of claim 7 further comprising at least one drawer extendable from the organizer base.

11. The hair styling accessory organizer of claim 7 wherein the tapered portion comprises a middle segment, a lower segment extending from the middle segment to the base portion and an upper segment extending from the middle segment to the terminal portion, the lower segment gradually increasing in cross-sectional diameter from the middle segment to the base portion and the upper segment gradually increasing in cross-sectional diameter from the middle segment to the terminal portion.

12. The hair styling accessory organizer of claim 7 further comprising at least one hair bun spindle upward-standing from the organizer platform.

13. A hair styling accessory organizer, comprising:

an organizer base;

at least one drawer extendable from the organizer base;

a rotatable circular organizer platform carried by the organizer base;

a plurality of generally elongated hair bead support members upward-standing from the organizer platform in adjacent, spaced-apart relationship to each other generally around a circumference of the organizer platform, each hair bead support member having a base portion of substantially constant cross-sectional diameter carried by the organizer platform, a tapered portion of gradually varying cross-sectional diameter extending from the base portion and a terminal portion of substantially constant cross-sectional diameter extending from the tapered portion;

at least one generally elongated, cylindrical accessory support member upward-standing from the organizer platform;

a hair styling accessory compartment carried by the organizer platform;

a cap carried by the at least one of the plurality of hair bead support members and a cap opening in the cap; and an accessory support ribbon carried by the cap opening in the cap.

14. The hair styling accessory organizer of claim 13 wherein the tapered portion is biconcave in longitudinal cross-sectional view and comprises a middle segment, a lower segment extending from the middle segment to the base portion and an upper segment extending from the middle segment to the terminal portion, the lower segment gradually increasing in cross-sectional diameter from the middle segment to the base portion and the upper segment gradually increasing in cross-sectional diameter from the middle segment to the terminal portion.

15. The hair styling accessory organizer of claim 13 further comprising at least one hair bun spindle upward-standing from the organizer platform.

* * * * *